US008033517B2

(12) United States Patent
Wilcoxon

(10) Patent No.: US 8,033,517 B2
(45) Date of Patent: Oct. 11, 2011

(54) LIQUID HOLDING DEVICE WITH RELEASABLE SUCTION BASE

(76) Inventor: Lori A. Wilcoxon, Rome, GA (US)

( * ) Notice: Subject to any disclaimer, the term of this patent is extended or adjusted under 35 U.S.C. 154(b) by 64 days.

(21) Appl. No.: 12/357,203

(22) Filed: Jan. 21, 2009

(65) Prior Publication Data

US 2010/0181457 A1 Jul. 22, 2010

(51) Int. Cl.
*F16B 47/00* (2006.01)

(52) U.S. Cl. ..... 248/309.3; 248/205.8; 248/206.2

(58) Field of Classification Search ..... 248/309.3, 248/205.8, 205.9, 205.5, 363, 362, 206.6, 248/205.7, 206.1, 206.2, 467; 220/630, 632, 220/737; D7/624.1

See application file for complete search history.

(56) References Cited

U.S. PATENT DOCUMENTS 2,565,793 A * 8/1951 Weismantel ..... 248/362
2,936,139 A * 5/1960 Lindstrom ..... 248/616
4,756,497 A * 7/1988 Lan ..... 248/205.9
4,941,635 A * 7/1990 Lan ..... 248/346.11

* cited by examiner

*Primary Examiner* — Gwendolyn Baxter
(74) *Attorney, Agent, or Firm* — Smith Risley Tempel Santos LLC; Matthew T. Hoots

(57) ABSTRACT

Generally, a liquid holding device with a releasable suction base is a mug or other container operable to hold a substance or device with an integral means for creating a secure suction force with a surface. More specifically, a component of the liquid holding device is not only operable to create a suction force, but the application of the suction force provides a means for stabilizing the device. Advantageously, once the liquid holding device is adhered to a surface via the suction mechanism component, the risk of accidental tipping of the device is greatly reduced. Further, an aspect of the present invention is a mechanism for the convenient creation and release of the stabilizing suction force. In some embodiments, the suction creation and release mechanism can be operated with a single hand. Advantageously, such an aspect provides a means for a user of the device to simply affect the stabilizing suction force when placing the liquid holding device adjacent to a smooth surface as well as conveniently release the suction force when movement of the device is desired.

13 Claims, 7 Drawing Sheets

LIQUID HOLDING DEVICE WITH RELEASABLE SUCTION BASE

BACKGROUND

As is often the case for better and safer product design, the present invention was inspired by a child. Most children are notoriously oblivious to all the things around them that may endanger their well being. Ignorance, or perhaps innocence, is truly bliss.

Blissful unawareness, however, is not a state usually enjoyed by an adult in charge of a toddler's safekeeping. If that adult, for instance, is a coffee drinker, then care must always be taken to prevent a curious toddler from reaching for a hot mug of coffee, lest the child be scalded. It is virtually guaranteed that a mug of coffee will be tipped should the adult in charge momentarily let their guard down. Similarly, hot bowls of soup, carafes of hot tea, or even mugs of stain producing grape juice are prime targets for a toddler's quick, grabby hands.

In all due fairness to toddlers, the risk of spills is not solely a function of their curious activities. Careless or clumsy adults are also to blame for their fair share of spillage. In hospitals or nursing homes, for instance, spills are a constant concern of caregivers. In a typical hospital room, surface space is crowded, caregivers are often in a hurry, and patients have compromised motor skills. The combination of such factors can create an environment where an accidental spill is almost inevitable.

Yet another fertile environment for spills is the car of a commuter. Inevitably, as soon as a commuter dares to place a mug of that hot nectar of alertness otherwise known as coffee into the car's cup holder, an impatient driver will surely swerve into his path and set off a chain reaction of slamming brakes and blaring tail lights. The coffee, of course, is destined to be spilled all over the car and the commuter's clothing.

Regardless of the price to be paid for spillage, whether it is a scalded toddler, a stained carpet, a soaked patient, or a severely inconvenienced commuter, it is clear that there is a need in the art for a liquid holding device with an integral means to prevent accidental spillage.

BRIEF SUMMARY

Generally, embodiments of the present invention are directed towards a liquid holding device with a releasable suction base is a mug or other liquid holding apparatus with an integral means for creating a secure suction force with a surface. More specifically, a component of the liquid holding device is not only operable to create a suction force, but the application of the suction force provides a means for stabilizing the device. Advantageously, once the liquid holding device is adhered, secured or affixed to a surface via the suction mechanism component, the risk of accidental tipping of the device is greatly reduced.

Further, an aspect of an exemplary embodiment of the present invention is a mechanism for the convenient creation and release of the stabilizing suction force. In some embodiments, the suction creation and release mechanism can be operated with a single hand. Advantageously, such an aspect provides a means for a user of the device to simply affect the stabilizing suction force when placing the liquid holding device adjacent to a smooth surface as well as conveniently release the suction force when movement of the device is desired.

One embodiment of the invention is a double walled mug fitted with a suction cup mechanism on its base and a suction release mechanism within its handle. At the center of the suction mechanism is a vertical path providing for the flow of air to enter the space contained between the mug walls. The space between the mug walls extends into at least a portion of the mug handle and includes the suction release mechanism. To create a mug stabilizing seal with a surface, a user of this embodiment opens the suction release mechanism, or valve, while applying a downward force on the mug to the surface. The combination of applying the downward force with the opening of the valve provides a free flow of air from the inner chamber of the suction mechanism, through the passageway contained between the mug walls, and out the open suction release valve. Before removing the downward force on the mug, the user releases the valve such that it re-seats and seals the free flow path of air. Once the suction valve has been re-seated, the user can then remove the downward force such that the suction cup base can operate to provide an upward force as it tries to regain its relaxed state. Advantageously, because the free flow of air has been restricted, the upward force of the suction cup base operates to create a suction force useful for stabilizing the mug. To release the suction so that the mug can be easily moved, the user opens the valve thereby providing for a free flow of air from the interior of the suction base to the exterior of the mug.

In another embodiment of the present invention, a suction release valve is not required.

Rather than including a suction release valve, the double walled mug with suction base described prior can be fitted with at least one flexible area within the rigid exterior mug wall. A user of such an embodiment could create a stabilizing suction force by applying a downward force on the mug while pressing the flexible wall area. In doing so, the effective volume encompassed between the double walls of the mug and interior of the suction base is reduced, thereby creating a vacuum-like seal when the suction base and flexible area attempt to regain their relaxed shape.

To disengage the suction force, a user again depresses the flexible wall area in order to "burp" the suction base and release the vacuum seal. Those skilled in the art will appreciate that the resilience to deformation attributed to the suction base and flexible wall area would have to differ to an extent such that the flexible wall area would be operable to regain its relaxed state while the suction base was still providing a vacuum creating, upward force.

The various embodiments of the present invention provide a means for a liquid holding device, such as a mug or bowl, to be stabilized via a releasable suction system. Advantageously, such embodiments drastically reduce the probability that the liquid contained within can be accidentally spilled. Further, the present invention provides a convenient means for creating and releasing the vacuum seal that stabilizes the device. The aforementioned advantages, as well as other aspects, features and embodiments of the present invention are presented in greater detail in the following description.

DETAILED DESCRIPTION OF THE INVENTION

Figure 1:
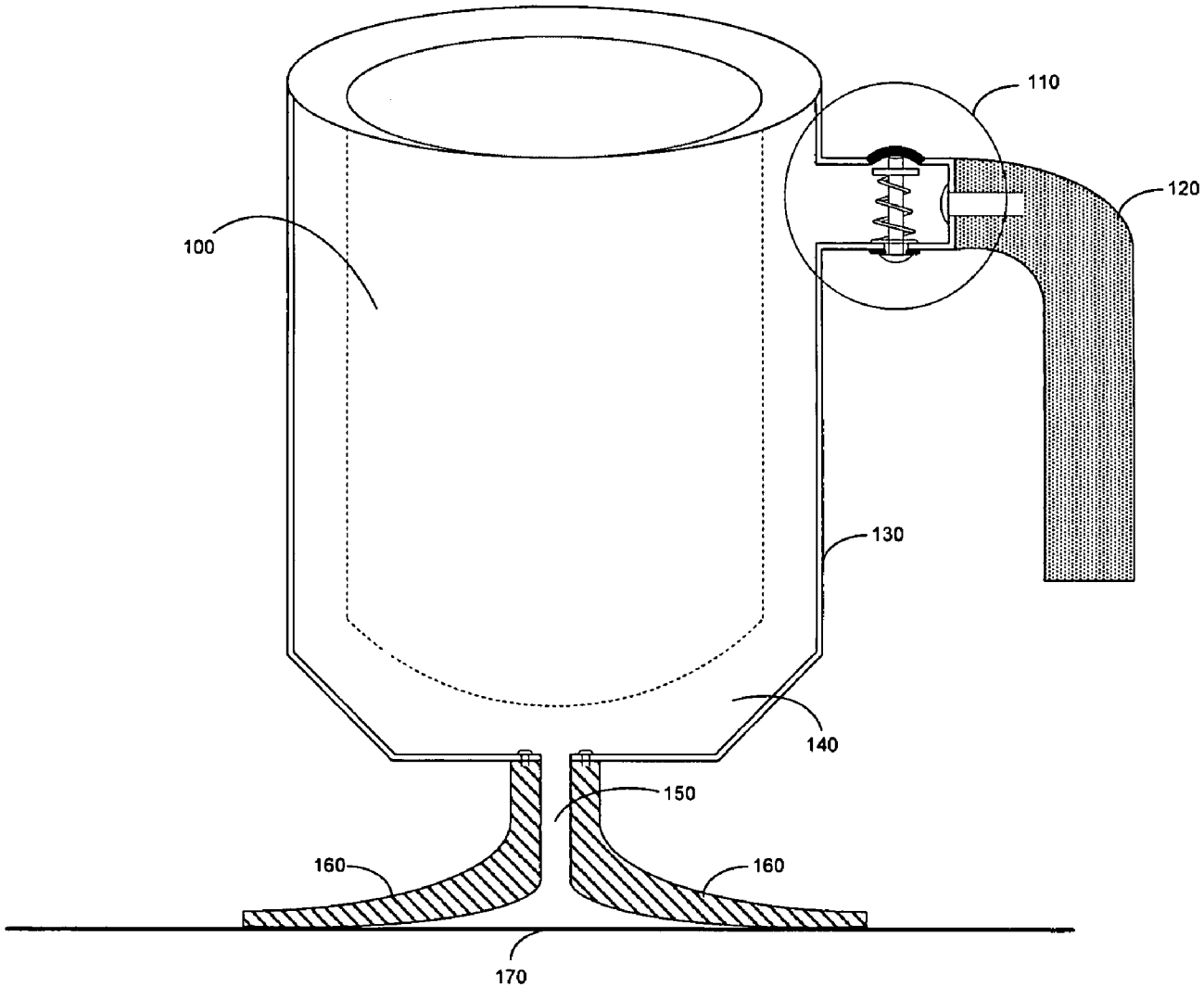
FIG. 1 is a cutaway view of one embodiment of the present invention that is operable to create a stabilizing suction force with a substantially horizontal surface and comprises a vacuum release mechanism located in a handle.

Embodiments of the present invention, as well as features and aspects thereof, are directed towards providing a device that can hold a liquid or other substance and are operable to resist tipping when fixed to a surface via a suction force. More specifically, the device may be actuated by a user to create a suction force that stabilizes the device against a surface. To move the device once it is fixed to a surface via a stabilizing suction force, a user can reverse actuate the device to remove the suction force.

In general, one embodiment of the present invention includes a mug or other container with an integral base that provides a means for creating a secure suction force with a substantially horizontal surface. More specifically, the suction force provided by the base component of the mug is a means for stabilizing the device. Advantageously, once the mug base is adhered to the surface, the risk of accidental tipping of the device is greatly reduced.

While most embodiments of the present invention are operable to create a stabilizing suction force with a substantially horizontal surface, it should be appreciated that such configuration is not a limiting aspect. Some embodiments of the invention may be operable to create a stabilizing suction force with a substantially vertical surface. For example, a suction creating component could be located on the side of the device such that when placed next to a vertical surface, a suction force is affected. An embodiment operable to create the stabilizing suction force against a substantially vertical surface could be utilized in a hospital if a vertical surface were provided integral to a patient's food tray or wheelchair. Advantageously, the force required to create the suction in such an embodiment would be a lateral push, as opposed to a downward force. An adequate pushing force for the creation of the stabilizing suction could be more easily created by a patient with compromised motor skills or minimal physical strength.

An aspect of embodiments of the present invention is a mechanism for the convenient creation and release of the stabilizing suction force. In some embodiments, the suction creation and release mechanism can be operated with a single hand. Advantageously, such an aspect provides a means for a user of the device to simply affect the stabilizing suction force when placing the liquid holding device adjacent to a smooth surface as well as conveniently release the suction force when movement of the device is desired. While the location and specific design of the suction release mechanism may be novel in and of itself, it should be appreciated that the specifics surrounding the suction release mechanism are not limiting aspects of the present invention.

One embodiment of the invention is a double walled container fitted with a suction cup mechanism on its base and a suction release mechanism within its handle. At the center of the suction mechanism is a vertical path providing for the flow of air to enter the space contained between the container walls. The space between the container walls extends into at least a portion of the container handle and includes the suction release mechanism. To create a container stabilizing seal with a surface, a user of the embodiment opens the suction release mechanism, or valve, while applying a downward force on the container to the surface. The combination of applying the downward force with the opening of the valve provides a free flow of air from the inner chamber of the suction mechanism, through the passageway contained between the mug walls, and out the open suction release valve. Before removing the downward force on the container, the user releases the valve such that it re-seats and seals the free flow path of air. Once the suction valve has re-seated, the user can then remove the downward force such that the suction cup base can operate to provide an upward force as it tries to regain its relaxed state. Advantageously, because the free flow of air has been restricted, the upward force of the suction cup base operates to create a suction force useful for stabilizing the container. To release the suction so that the container can be easily moved, the user opens the valve thereby providing for a free flow of air from the interior of the suction base to atmosphere.

While some embodiments of the present invention are comprised of a double walled, cup-like structure that provides a space between the walls for air to travel from the interior of the suction creating component to the suction release valve, it should be appreciated that such a design does not limit the scope of the invention. For example, in embodiments that require a flow path for air, the flow path may be created via a tube, either internal or external to the device structure. Notably, in such an embodiment that uses a tube for the air path, a multi-walled configuration would not be required.

Further, it is readily known to those skilled in the art of liquid holding devices that multi-walled apparatuses containing hermetically sealed vacuum chambers, or chambers filled with heat transfer resistant materials, provide advanced insulating properties useful for keeping the contained liquid within a desired temperature range. While perceivably novel in and of itself, insulating techniques or aspects should not limit the scope of the current invention. In fact, embodiments of the present invention may provide a series of two or more concentric walls that create chambers operable to provide insulating characteristics separate from, or in addition to, a flow path for air.

In another embodiment of the present invention, a suction release valve is not required. Rather than including a suction release valve, a double walled mug embodiment with a suction component can be fitted with at least one flexible area within the rigid exterior container wall. A user of such an embodiment having a suction component on its base could create a stabilizing suction force by applying a downward force on the container while pressing the flexible wall area. In doing so, the effective volume encompassed between the double walls of the mug and interior of the suction base is reduced, thereby creating a vacuum-like seal when the suction base and flexible area attempt to regain their relaxed shape.

To disengage the suction force, a user again depresses the flexible wall area in order to "burp" the suction base and release the vacuum seal. Those skilled in the art will appreciate that the resilience to deformation attributed to the suction base and flexible wall area would have to differ to an extent such that the flexible wall area would be operable to regain its relaxed state while the suction base was still providing a vacuum creating, upward force.

Materials of construction for various components of various embodiments of the present invention may vary without limiting the scope of the invention. It should be appreciated that choices of materials for various components, and the subsequent performance characteristics attributed to those choices, will be known to those skilled in the specific art.

Turning now to the figures, where like labels represent like elements throughout the drawings, various aspects, features and embodiments of the present invention will be presented in more detail. The examples as set forth in the drawings and detailed description are provided by way of explanation of the invention and are not meant as limitations of the invention. The present invention thus includes any modifications and variations of the following examples as come within the scope of the appended claims and their equivalents.

FIG. 1 is a cutaway view of one embodiment of the present invention that shows a mug with a vacuum release mechanism 110 located in the handle 120. It should be appreciated that although the various embodiments are described as being incorporated into a mug, any other type of container may also incorporate aspects of the invention. For instance, a few non-limiting examples may include a measuring cup, a paint holding container, a beaker, a flower vase, a telephone holder, a remote control, a bowl, a pitcher, a cup holder, a bottle holder, a can holder, a handled or un-handled receptacle suitable for receiving a container, etc. More specifically, the embodiment depicted in FIG. 1 is of a double walled configuration. A flow path 140 of air leading from the interior space 150 of the suction base component 160 to the suction release valve 110 is created between the exterior surface of the interior wall 100 and the interior surface of the exterior wall 130. Advantageously, the device is operable to be stabilized from tipping when a suction force is created by the suction base component 160 in conjunction with a substantially horizontal surface 170.

To create or release a stabilizing suction force, the vacuum release mechanism 110 is actuated. For illustrative purpose, one possible configuration of the vacuum release mechanism 110 is of a valve type and is depicted in closer detail in FIG. 2A and FIG. 2B. Moving to FIG. 2A, the illustrative vacuum release mechanism 110, or valve, is shown in a seated position. In an embodiment that makes use of a valve version of a suction release mechanism, the valve 110 is communicable to the flow path 140 of air that leads from the space 150 contained within the interior of the suction component 160. When seated, the valve 110 operates to seal the flow path 140 and prevent or substantially restrict the escape of air.

Figure 2A:
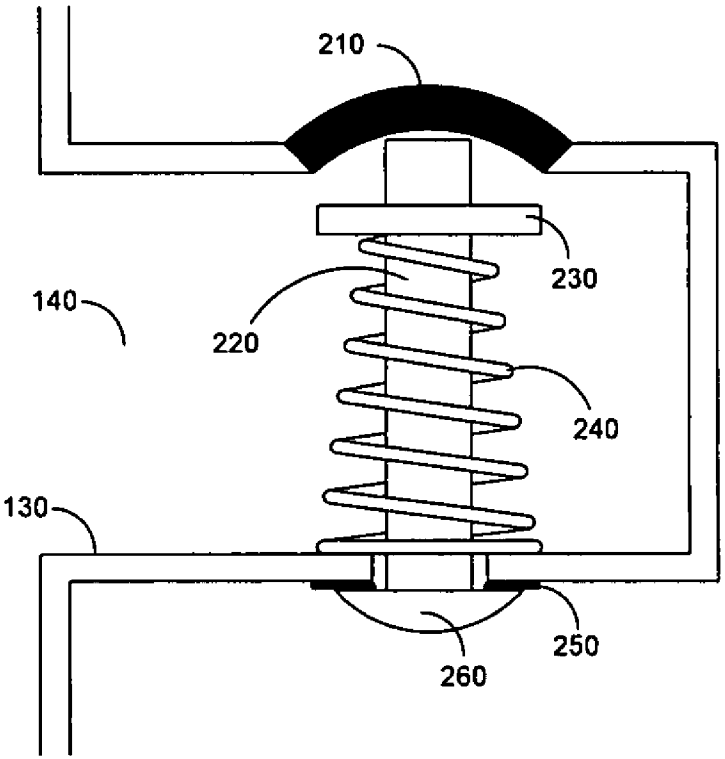
FIG. 2A is an illustration of one embodiment of a vacuum release aspect in a seated position.

In FIG. 2A, a spring 240 provides an upward force on a valve stem 220 that, in turn, deflects a material comprising a button 210. Notably, the button material may vary without limiting the scope of the invention and will be known to those skilled in the art. Even so, the button material in the embodiment illustrated here will be more flexible than the outer wall 130 material to which it is attached. To translate the upward force created by the spring 240 to the valve stem 220, a collar 230 is integral to, or rigidly attached to, the valve stem 220. Further, a material suitable to create a full or substantially air tight seal is used as a seat 250 to the valve plug 260. In this way, the force provided by the spring 240 is operable to not only deflect the material comprising the button 210, but also seat the valve plug 260 securely into the seat 250 material to affect an air tight seal.

Figure 2B:
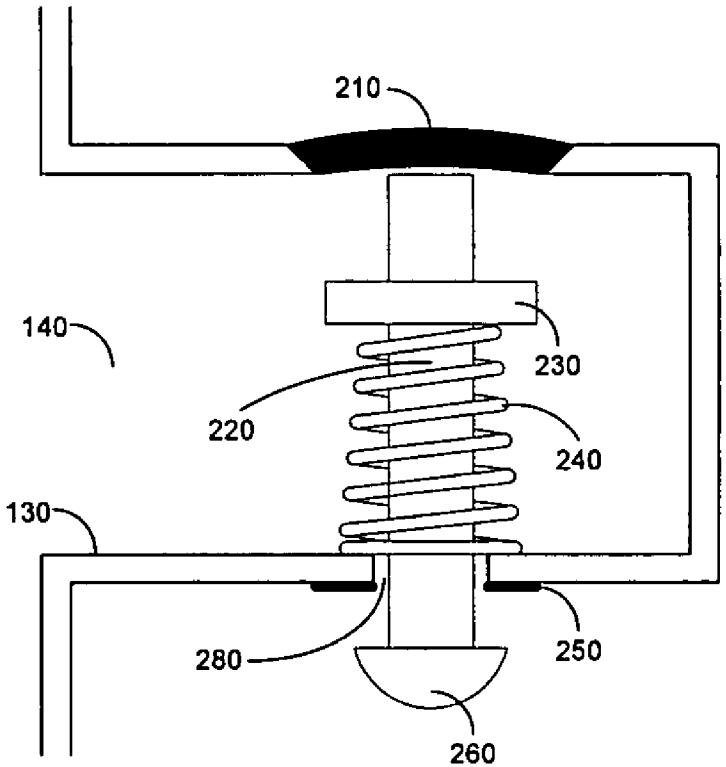
FIG. 2B is an illustration of one embodiment of a vacuum release aspect in an open position.

To release the suction force held by the seated suction release valve 110 so that the device may be moved, the user opens the valve 110 and creates a free flow path 140 of air from the interior space 150 of the suction component 160 to the open valve port 280 best illustrated in FIG. 2B. FIG. 2B depicts the vacuum release valve 110 in such an open position. With the button 210 depressed by the user, a force overcoming the spring 240 constant is applied to the top of the valve stem 220. The force is translated to the spring 240 via a collar 230 that is integral to, or rigidly attached to, the valve stem 220. Because the spring 240 is compressed, the valve plug 260 is separated from the valve seat 250. The separation breaks the suction as the flow path 140 is opened to atmosphere 280. Release of the force applied to the button 210 by the user operates to allow the spring 240 to expand and reseat the valve mechanism 110 as previously shown in FIG. 2A.

Figure 3:
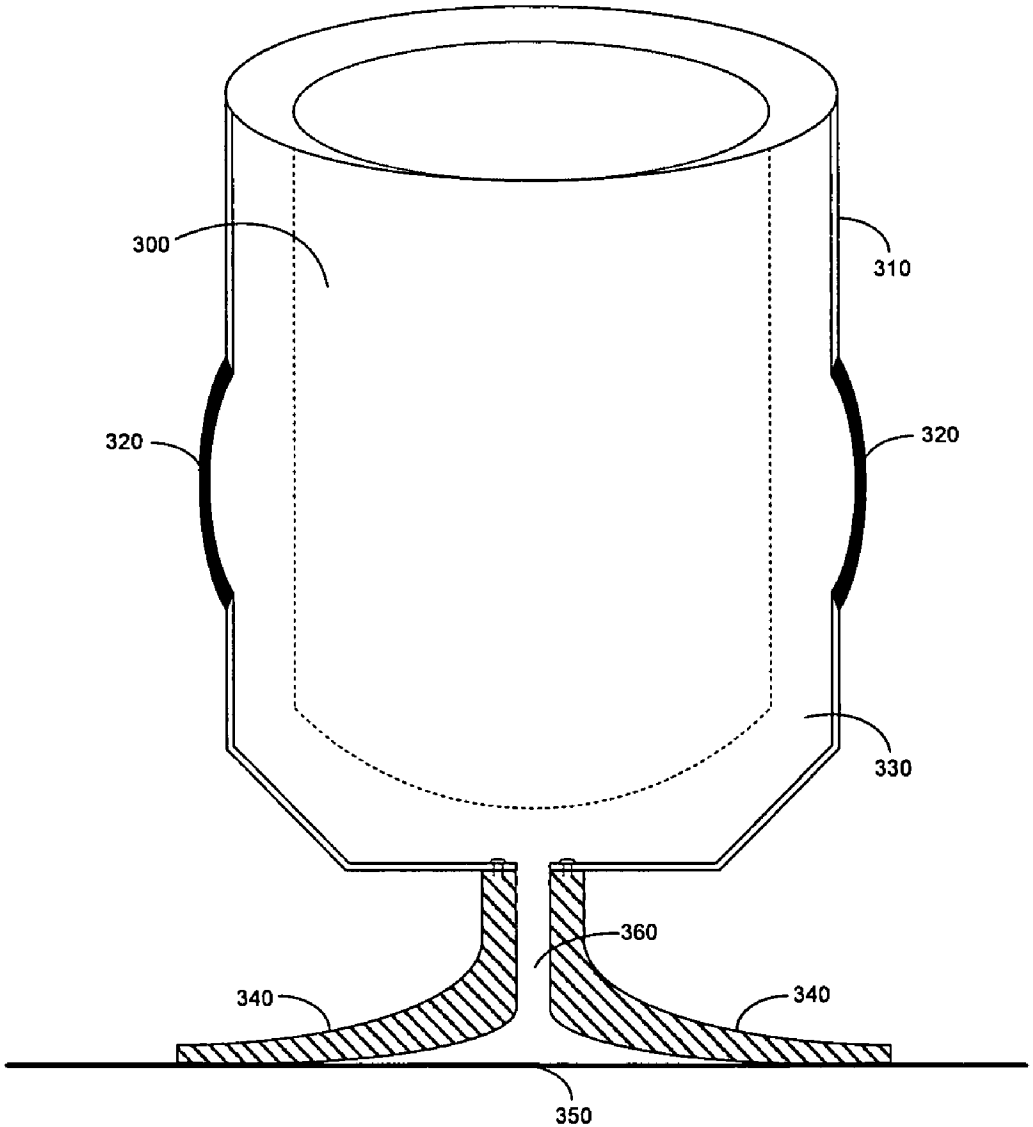
FIG. 3 is a cutaway view of one embodiment of the present invention that shows a container with flexible areas in the outer wall.

Moving now to FIG. 3, depicted is one embodiment of the present invention that is a mug or other container or device with flexible areas 320 in the rigid outer wall 310. Notably, the embodiment illustrated in FIG. 3 does not require the use of a suction release valve 110 as described prior. In the illustrated embodiment, similar to the embodiment of FIG. 1, a suction component 340 is operable to create a suction force with a substantially horizontal surface 350. Also similar to the embodiment described in FIG. 1, the mug depicted is of a double wall configuration and provides a flow path 330 of air leading from the interior space 360 of the suction base component 340 into the space defined by the exterior surface of the interior wall 300 and the interior surface of the exterior wall 310.

The embodiment depicted in FIG. 3 differs from that depicted in FIG. 1, however, in that the FIG. 3 embodiment does not require a suction release valve 110. Rather, the FIG. 3 embodiment of the present invention employs flexible areas 320 integrated into the rigid body of the outer wall 310. The amount of flexible areas, size of flexible areas, shape of flexible areas, location of flexible areas, or material of construction for flexible areas may be novel in and of themselves but should not be considered as limiting factors to the scope of the present invention.

To create a stabilizing suction force between the suction component 340 and the surface 350, the user squeezes the flexible areas 320 while applying a downward force to the device onto the surface 350. Once the suction component 340 of the device is in contact with the surface 350 as a result of the downward force, the shape of the suction component 340 is deformed in such a way that the interior space 360 is lessened. The user can then release the flexible areas 320 which are operable to regain their relaxed shape. The outward force created by the expansion of the flexible areas 320 along with the upward force of the suction component 340 as it tries to regain its relaxed shape operates to create a suction force.

The suction force created by the above described method for using an embodiment such as that depicted in FIG. 3 can be released by the user deflecting the flexible areas 320 inward. The inward deflection creates a force that can "burp" the suction component 340 and break the vacuum seal.

It will be appreciated that in many applications, a smooth and/or flat surface may not be readily available for seating the container and creating a substantial vacuum to hold the container in position. As such, embodiments of the present invention may also include a base that can be mounted by other means to such a surface or structure. The base includes a smooth flat surface that can receive the suction cup (i.e., element 160 in FIG. 1) and provide a suitable surface for seating the container.

It will also be appreciated that a container incorporating aspects of the present invention can be used to create or provide a secured cup holder or container holder in the absence thereof. For instance, the container shown in FIG. 1 may simply operate as a receptacle or holder into which a cup or glass can be placed and secured. Further, the container may include a handle as depicted in FIG. 1 such that the cup placed within the container can be lifted and moved and reseated.

Figure 4:
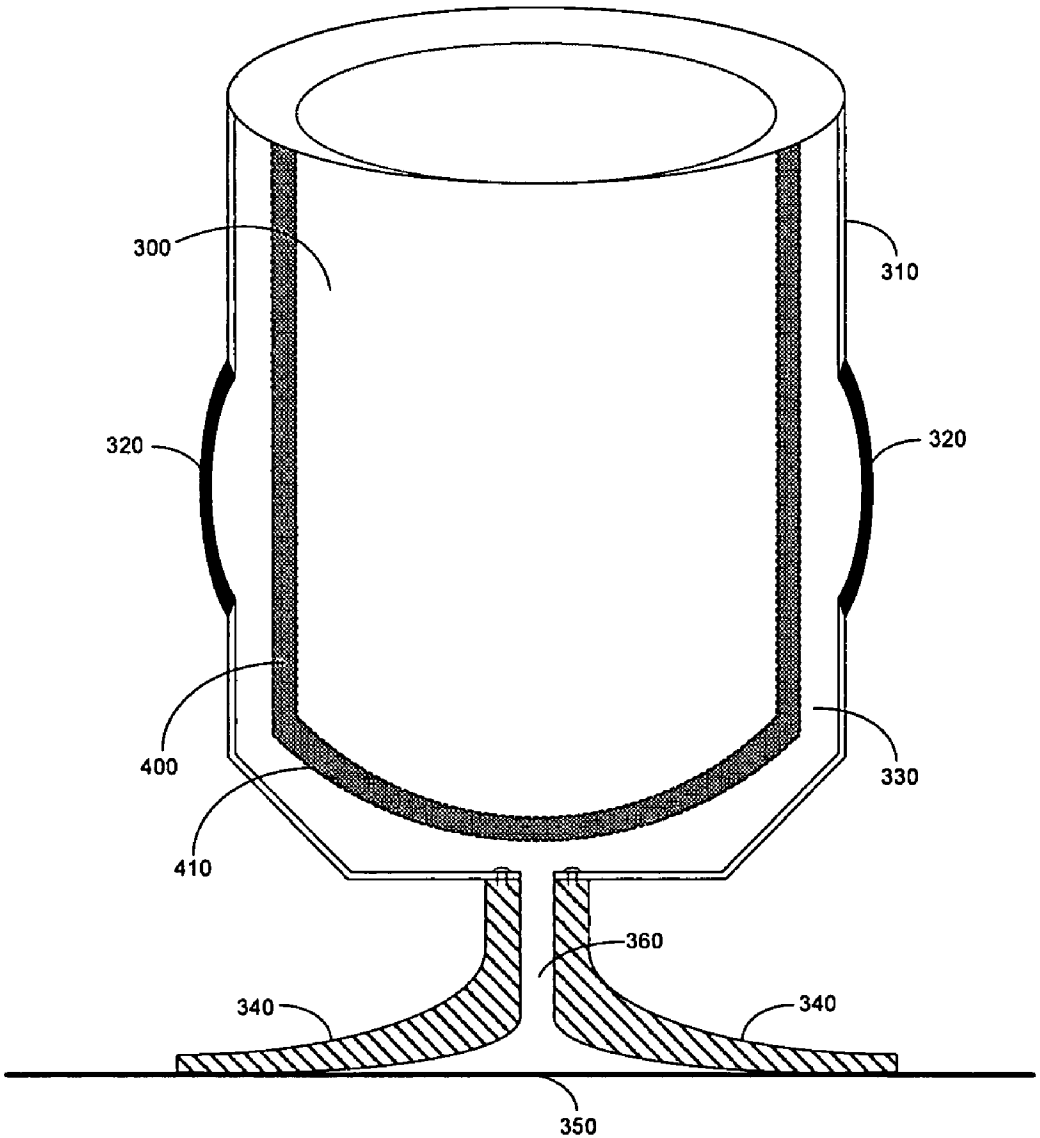
FIG. 4 is a cutaway view of one embodiment of the present invention that comprises multiple interior walls defining separate spaces for air flow and insulation.

Moving now to FIG. 4, an embodiment of the present invention is depicted which includes an aspect of multiple concentric interior walls. More specifically, with the exception of multiple concentric interior walls, the overall embodiment illustrated in FIG. 4 is substantially equivalent in design and operation to that which has been previously described in relation to FIG. 3. The inclusion of multiple interior walls provides embodiments of the present invention with a means for improving the insulating properties of the overall device. While the space 330 defined by the exterior surface of interior wall 410 and the interior surface of wall 310 is communicable with the interior space 360 of the suction base component 340 for the purpose of creating a device stabilizing suction force, the space 400 defined by the interior surface of the interior wall 410 and the exterior surface of the interior wall 300 is operable to contain a hermetically sealed vacuum, foam, or some other material for the purpose of providing improved insulating properties. Notably, the inclusion of multiple chambers, whether concentric in nature or not, is not limited to the embodiment illustrated in FIG. 4. In fact, while insulating aspects of embodiments of the present invention may be novel in and of themselves, it should be appreciated that various insulating aspects and materials are known to those skilled in the art of liquid holding devices and the inclusion of such aspects in an embodiment of the present invention should not limit the scope of the invention.

Figure 5:
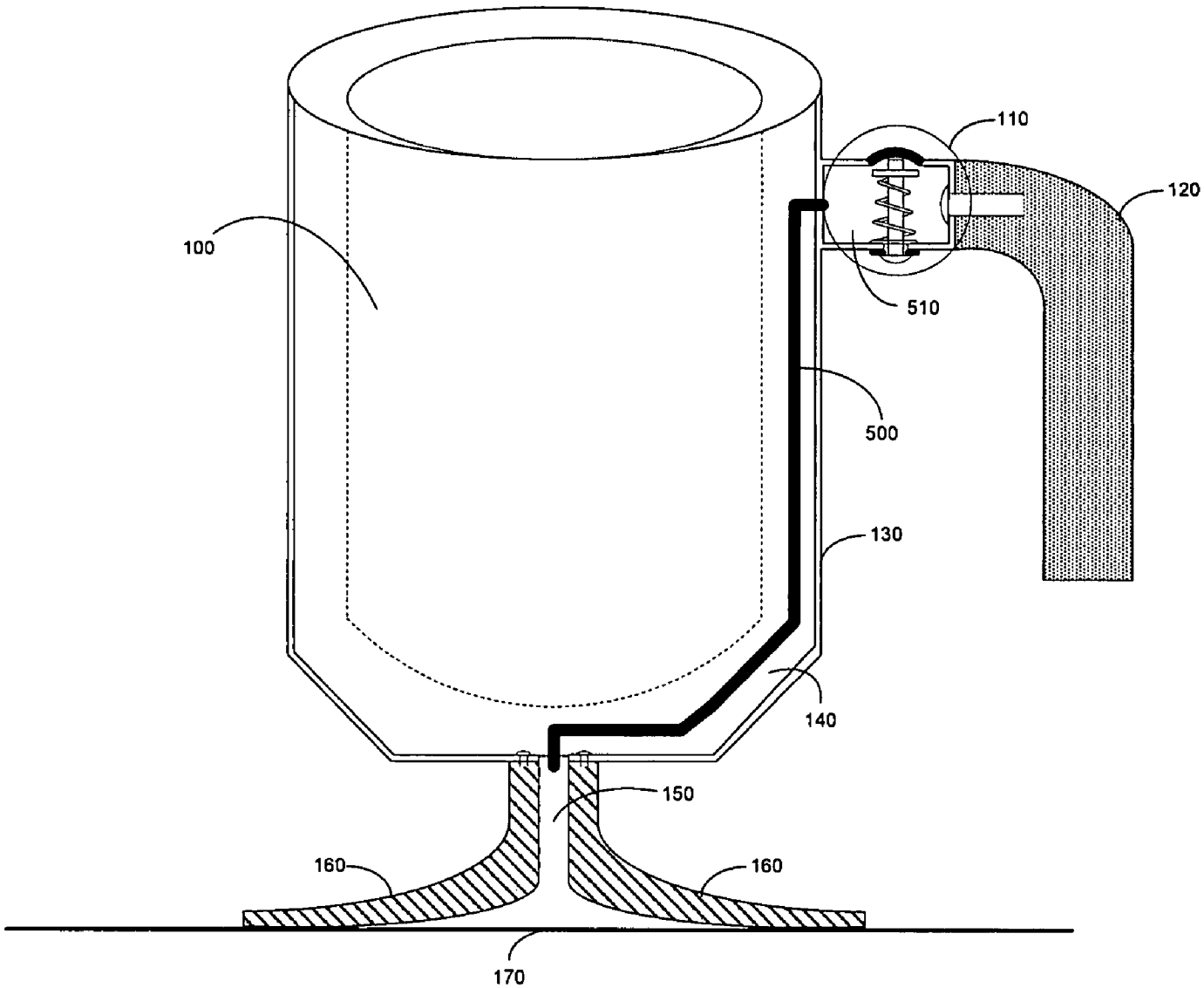
FIG. 5 is a cutaway view of one embodiment of the present invention that comprises a tube aspect operable to provide an air flow path.

FIG. 5 is yet another illustrative embodiment of the present invention and, in addition to the features described relative to FIG. 1, incorporates a tube aspect operable to provide a flow path for air from the interior space 150 of the suction creating component 160 to a space 510 communicable to the suction release valve 110. In the illustrated embodiment, the tube 500 provides the air flow path instead of the space defined by the exterior surface of the interior wall 100 and the interior surface of the exterior wall 130. Advantageously, an embodiment that utilizes a tube, or the like, to provide a flow path would not require a double wall construction as the tube could be included in a solid wall. Also, the use of a tube aspect such as that described herein could provide for the interior space defined by a double wall configuration to be used for insulating purpose in lieu of a flow path. Further, it should be appreciated that the tube, while depicted in FIG. 5 as lying within the device, could be located on the exterior of some embodiments.

Figure 6:
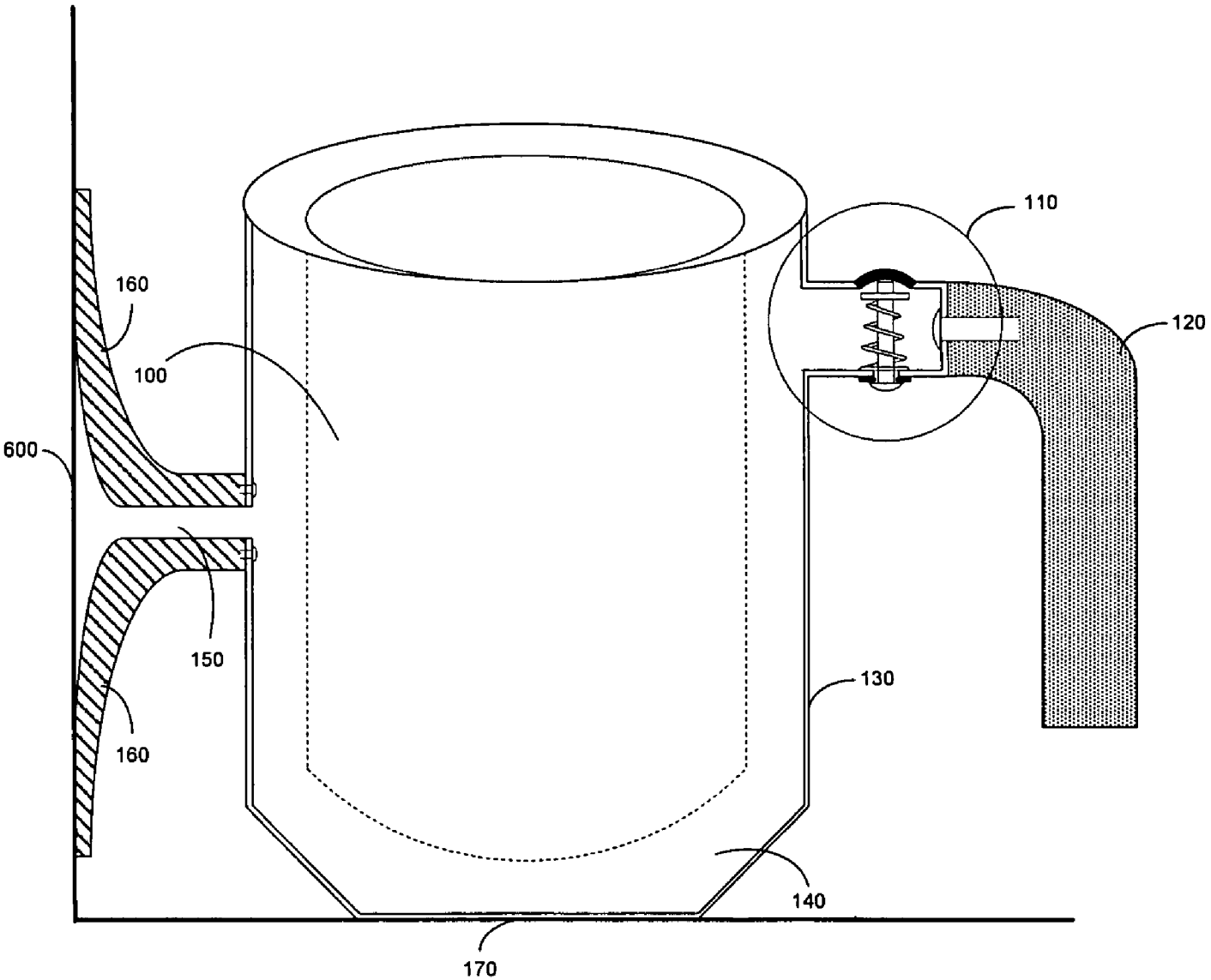
FIG. 6 is a cutaway view of one embodiment of the present invention that is operable to create a stabilizing suction force with a substantially vertical surface and comprises a vacuum release mechanism located in a handle.

FIG. 6 is a mug embodiment of the present invention similar to that which was described prior relative to FIG. 1. The embodiment depicted in FIG. 6 differs from that depicted in FIG. 1, however, as the FIG. 6 embodiment illustrates a suction creating component 160 communicable to the side of the device as opposed to the bottom. Advantageously, such a configuration is operable to create a stabilizing suction force with a substantially vertical surface 600.

The present invention has been described using detailed descriptions of embodiments thereof. The embodiments are provided by way of example and are not intended to limit the scope of the invention. The described embodiments comprise different features, not all of which are required in all embodiments of the invention. Some embodiments of the present invention utilize only some of the features or possible combinations of the features. Variations of embodiments of the present invention that are described and embodiments of the present invention comprising different combinations of features noted in the described embodiments will occur to persons of the art.

It will be appreciated by persons skilled in the art that the present invention is not limited by what has been particularly shown and described herein above. Rather the scope of the invention is defined by the claims that follow.

What is claimed is:

1. A liquid holding device that resists tipping when fixed to a surface via a suction force, the device comprising:

a component for holding a substance or device;

a component operable to create a suction force, wherein the component operable to create a suction force is integral to said component for holding a substance or device;

a suction release mechanism; and a flow path connecting the interior of said suction force component to said suction release mechanism;

wherein the component for holding a substance or device comprises two walls such that an air space is created between the exterior surface of the interior wall and the interior surface of the exterior wall.

2. The device of claim 1, wherein the air space created between the exterior surface of the interior wall and the interior surface of the exterior wall functions as the flow path connecting the interior of said suction force component to said suction release mechanism.

3. The device of claim 1, wherein the component for holding a substance or device comprises three or more walls such that:

an air space is created between the exterior surface of an interior wall and the interior surface of another wall; and an insulating space is created between the exterior surface of an interior wall and the interior surface of another wall.

4. The device of claim 3, wherein the insulating space is hermetically sealed.

5. The device of claim 3, wherein the insulating space is sufficient to maintain a vacuum.

6. The device of claim 3, wherein the insulating space contains a material with properties that resist heat transfer.

7. The device of claim 3, wherein the air space created between the exterior surface of an interior wall and the interior surface of another wall functions as the flow path connecting the interior of said suction force component to said suction release mechanism.

8. The device of claim 1, wherein the flow path connecting the interior of said suction force component to said suction release mechanism is comprised of a tube.

9. The device of claim 8, wherein said tube is located within said component for holding a substance or device.

10. The device of claim 8, wherein said tube is located on the exterior of said component for holding a substance or device.

11. The device of claim 1, wherein said suction release mechanism is a spring loaded valve operable to make and break the seal of said flow path.

12. The device of claim 1, wherein said suction release mechanism comprises at least one flexible area on the outer wall of the device operable to modify the volume of said flow path when actuated.

13. The device of claim 1, wherein the component operable to create a suction force is positioned relative to the component for holding a substance or device such that the component for holding a substance or device remains operable to hold a substance or device when the component operable to create a suction force is actuated against a non-horizontal surface.

* * * * *